US010365587B2

(12) United States Patent
Shindo et al.

(10) Patent No.: US 10,365,587 B2
(45) Date of Patent: Jul. 30, 2019

(54) IMAGE FORMING APPARATUS, PROCESS CARTRIDGE, AND DEVELOPING APPARATUS INCLUDING DEVELOPING ROLLER

(71) Applicant: CANON KABUSHIKI KAISHA, Tokyo (JP)

(72) Inventors: Go Shindo, Mishima (JP); Daisuke Baba, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/142,564

(22) Filed: Sep. 26, 2018

(65) Prior Publication Data

US 2019/0101850 A1 Apr. 4, 2019

(30) Foreign Application Priority Data

Sep. 29, 2017 (JP) ..... 2017-190450

(51) Int. Cl.
*G03G 15/08* (2006.01)

(52) U.S. Cl.
CPC ..... *G03G 15/0898* (2013.01)

(58) Field of Classification Search
None
See application file for complete search history.

(56) References Cited

U.S. PATENT DOCUMENTS 5,202,729 A * 4/1993 Miyamoto ..... G03G 15/0928 399/103
6,311,031 B1 * 10/2001 Hirano ..... G03G 15/168 399/101
7,346,300 B2 3/2008 Inami et al.
9,519,241 B2 12/2016 Kitamura
2004/0223789 A1 * 11/2004 Inami ..... G03G 15/09 399/252
2009/0142101 A1 * 6/2009 Kosuge ..... G03G 15/5033 399/237
2016/0091804 A1 * 3/2016 Nukada ..... G03G 5/02 430/56

FOREIGN PATENT DOCUMENTS

JP 4585830 B2 11/2010
JP 2016057352 A 4/2016

* cited by examiner

*Primary Examiner* — Sevan A Aydin
(74) *Attorney, Agent, or Firm* — Rossi, Kimms & McDowell LLP

(57) ABSTRACT

A developing apparatus includes: a developing roller; a frame configured to support the developing roller at each of two end portions of the developing roller in a longitudinal direction of the developing roller; and a sealing member configured to seal a space between the frame and each of the two end portions of the developing roller. A first lubricant having an average particle size smaller than a predetermined surface roughness Ra is applied to a first region that is located at each end portion of the developing roller in the longitudinal direction and is in contact with the sealing member. A second lubricant having an average particle size larger than the surface roughness Ra is applied to a second region that is located on an inner side of the first region in the longitudinal direction and is separated from the sealing member and has the surface roughness Ra.

18 Claims, 7 Drawing Sheets

IMAGE FORMING APPARATUS, PROCESS CARTRIDGE, AND DEVELOPING APPARATUS INCLUDING DEVELOPING ROLLER

BACKGROUND OF THE INVENTION

Field of the Invention

The present invention relates to an image forming apparatus such as a copying machine or a printer, which forms images with the use of an electrophotographic system or an electrostatic recording system, and a process cartridge and a developing apparatus.

Description of the Related Art

For example, an electrophotographic image forming apparatus (hereinafter referred to as "image forming apparatus"), such as a copying machine or a laser beam printer, charges the surface of an image bearing member (hereinafter referred to as "photosensitive member") with charging portion, and irradiates the photosensitive member with light corresponding to image data, to thereby form an electrostatic image (hereinafter referred to as "latent image"). Then, the apparatus supplies, to the latent image, toner serving as developer, which is a recording substance, from developing unit to form a visible toner image. The apparatus transfers the toner image, with transferring portion, from the photosensitive member to a recording material such as a recording sheet, and fixes the toner image on the recording material with fixing unit, to thereby form a recorded image. The apparatus cleans toner remaining on the photosensitive member after the transfer with cleaning member, and uniformly exposes the surface of the photosensitive member after the transfer with pre-exposure unit to eliminate marks of the latent image. The apparatus then charges the surface of the photosensitive member again with the charging portion.

Electrophotographic image forming apparatus use a non-magnetic one component contact developing system because it is advantageous in reproducibility of halftone images and in reduction in excessive edge effect on images. The non-magnetic one component contact developing system is a system in which a developer bearing member of developing unit is brought into contact with a photosensitive member, and a latent image formed on the photosensitive member is developed with the use of toner (non-magnetic one component developer) containing no magnetic body. The contact developing system generally has a configuration in which one of the photosensitive member and the developer bearing member is an elastic body (including a sheet supported by an elastic body) and the other is a rigid body so that the photosensitive member and the developer bearing member are in uniform and close contact with each other in their respective rotation directions. In the simplest configuration, the photosensitive member is a rigid body and the developer bearing member is an elastic body. In particular, when an image forming apparatus includes a photosensitive member and a developing roller, which is a developer bearing member, as a process cartridge that is removably mounted to the main body of the image forming apparatus, the above-mentioned combination is often employed.

The developing roller is mounted to the opening portion of a developing frame of the process cartridge, and a developing roller peripheral surface sealing method is popular as a toner sealing method for the two end portions of the developing roller in its rotation axis direction (hereinafter referred to as "longitudinal direction"). In this method, a developing roller longer than the length of a developer container opening portion in the longitudinal direction is used. Moreover, at each of the two end portions of the developing roller, an arc-shaped developer sealing member is bonded to the developing frame to face the peripheral surface of the developing roller. As the developer sealing member, a fiber-planted material such as a felt material, a pile fabric, or moltoprene is used. In this way, developer is sealed with the developer sealing member being pressed against the peripheral surface of the developing roller. Thus, at each of the two end portions of the developing roller in the longitudinal direction, there are formed first regions (hereinafter referred to as "toner non-coating region) in which no developer is borne, and a second region (hereinafter referred to as "toner coating region) which is located further toward the inner side than the first region, and in which the developer is borne on the peripheral surface of the developing roller.

Further, in the non-magnetic one component contact developing system, the following phenomenon is a problem: toner is adhered to a non-image forming region on the drum (hereinafter referred to as "fogging") because the toner cannot be magnetically held on the developing roller. This phenomenon occurs when the toner has low charging performance or the toner is charged to a polarity opposite to a desired charging polarity of the toner. To cope with this, a developer layer thickness regulating member is generally provided on the developing roller so as to be in contact therewith so that the toner is regulated and charged, and fogging is prevented. Here, in order to obtain excellent charging performance of the toner, the toner on the developing roller needs to be a thin layer, and the surface roughness of the developing roller is set to be low. The developing roller is often given a surface roughness of from about 0.5 to about 2.5 as a center line average roughness Ra (JIS B0601:2001). The center line average roughness Ra is hereinafter referred to as "roughness Ra".

In addition, in the system in which the developer layer thickness regulating member is in contact with the developing roller, there is a configuration in which lubricant is applied on the developing roller so that the developer layer thickness regulating member is not damaged when the cartridge is used for the first time. Such a configuration is proposed in, for example, Japanese Patent No. 4585830 and Japanese Patent Application Publication No. 2016-057352. In particular, Japanese Patent Application Publication No. 2016-057352 proposes a configuration in which a coating agent in a polarity opposite to toner is used so that the coating agent does not disappear from a toner non-coating region on a developing roller.

SUMMARY OF THE INVENTION

The configuration in Japanese Patent Application Publication No. 2016-057352, however, has a problem that a developer sealing member mechanically takes the coating agent in the toner non-coating region, and the coating agent on the developing roller is thus reduced. As a result of the reduction in coating agent, frictional force between the developing roller and the photosensitive member may rise. Stick-slip of rubber that is an elastic body of the surface layer of the developing roller may be consequently caused, and toner on the drum may be disturbed with the period of stick-slip, leading to an image with periodic lateral shading stripes. Here, stick-slip is self-excited vibration that occurs between friction surfaces when the friction surfaces repeats adhesion and sliding. An image adversely affected by this stick-slip is hereinafter referred to as "banding image". In addition, in the toner coating region, if the coating agent still remains on the developing roller after the cartridge has been put into use, the coating agent causes melt adhesion with the developer layer thickness regulating member, with the result that toner on the developing roller is disturbed, leading to an adverse effect of vertical streaks on an image.

Objects of the present invention are to provide an electrophotographic image forming apparatus, a process cartridge, and a developing apparatus configured to prevent formation of banding images by increasing the retention of a coating agent in a toner non-coating region while achieving quick disappearance of a coating agent in a toner coating region, to thereby reduce friction between a developing roller and a photosensitive member.

In order to achieve the above-mentioned object, a developing apparatus of the present invention includes:

a developing roller configured to bear developer;

a frame configured to rotationally support the developing roller at each of two end portions of the developing roller in a longitudinal direction of the developing roller; and a sealing member configured to seal a space between the frame and each of the two end portions of the developing roller, wherein the developing roller has:

first regions that are located at each of the two end portions of the developing roller in the longitudinal direction and are in contact with the sealing member; and a second region that is located between the first regions in the longitudinal direction and is not in contact with the sealing member, the second region having a predetermined surface roughness Ra, wherein the first regions have a first lubricant applied thereto, the first lubricant having a first average particle size smaller than the predetermined surface roughness Ra, and wherein the second region has a second lubricant applied thereto, the second lubricant having a second average particle size larger than the predetermined surface roughness Ra.

Further, in order to achieve the above-mentioned object, a developing roller of the present invention has:

first regions which are located on a surface of the developing roller at each of two end portions of the developing roller in a longitudinal direction thereof and with which a sealing member is in contact, the sealing member being configured to seal a space between the developing roller and a frame by which the developing roller is rotationally supported; and a second region that is located between the first regions in the longitudinal direction and is not in contact with the sealing member, the second region having a predetermined surface roughness Ra, wherein the first regions have a first lubricant applied thereto, the first lubricant having a first average particle size smaller than the predetermined surface roughness Ra, and wherein the second region has a second lubricant applied thereto, the second lubricant having a second average particle size larger than the predetermined surface roughness Ra.

Further, in order to achieve the above-mentioned object, a process cartridge of the present invention includes:

an image bearing member on which an electrostatic latent image is formed; and the above-mentioned developing apparatus.

Moreover, in order to achieve the above-mentioned object, an image forming apparatus of the present invention includes:

an apparatus main body; and the above-mentioned process cartridge, which is removably mounted to the apparatus main body.

Further, in order to achieve the above-mentioned object, a developing apparatus of the present invention includes:

a developing roller configured to bear developer and having a surface to which lubricant is applied;

a frame configured to rotationally support the developing roller at each of two end portions of the developing roller in a longitudinal direction of the developing roller; and a sealing member configured to seal a space between the frame and each of the two end portions of the developing roller, wherein the developing roller has:

first regions that are located at each of the two end portions of the developing roller in the longitudinal direction and are in contact with the sealing member; and a second region that is located between the first regions in the longitudinal direction and is not in contact with the sealing member, wherein a surface roughness in the first regions on the developing roller is larger than an average particle size of the lubricant, and wherein a surface roughness in the second region on the developing roller is smaller than the average particle size of the lubricant.

As described above, according to the present invention, in the configuration of the non-magnetic one component contact developing system, the coating agent particle size in the toner coating region is large and the coating agent particle size in the toner non-coating region is small, with respect to the roughness of the developing roller. With this configuration, the coating agent in the toner non-coating region can be prevented from disappearing while the disappearance of the coating agent in the toner coating region that is exhibited after the process cartridge has been put into use is maintained. As a result, there can be provided the developing apparatus capable of preventing formation of banding images that is caused along with a rise in frictional force in the toner non-coating region, while preventing formation of images with vertical streaks that is caused due to coating agent melt adhesion with the layer thickness regulating member in the toner coating region.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

The present invention has a feature that two types of coating agents are applied to a toner non-coating region and a toner coating region on a developing roller so that the following relationship is satisfied: a coating agent particle size in the toner non-coating region is smaller than a roughness Ra of the developing roller, and a coating agent particle size in the toner coating region is larger than the roughness Ra of the developing roller. With this configuration, the retention of the coating agent in the toner non-coating region is increased while quick disappearance of the coating agent in the toner coating region is achieved, with the result that friction between the developing roller and a photosensitive member is reduced. Consequently, formation of banding images is prevented. Now, an embodiment of the present invention is described on the basis of the figures.

(1) Outline of Configuration and Operation of Image Forming Apparatus

Figure 2:
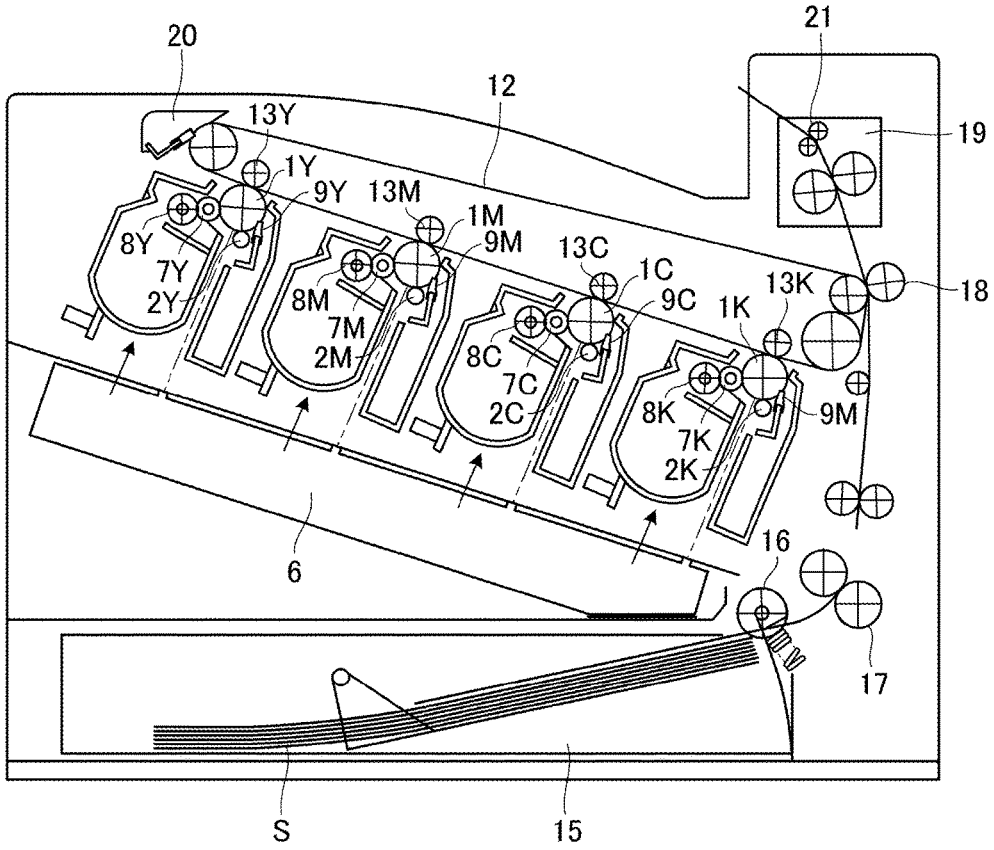
FIG. 2 is a sectional view of an image forming apparatus according to Embodiment 1.
Figure 3:
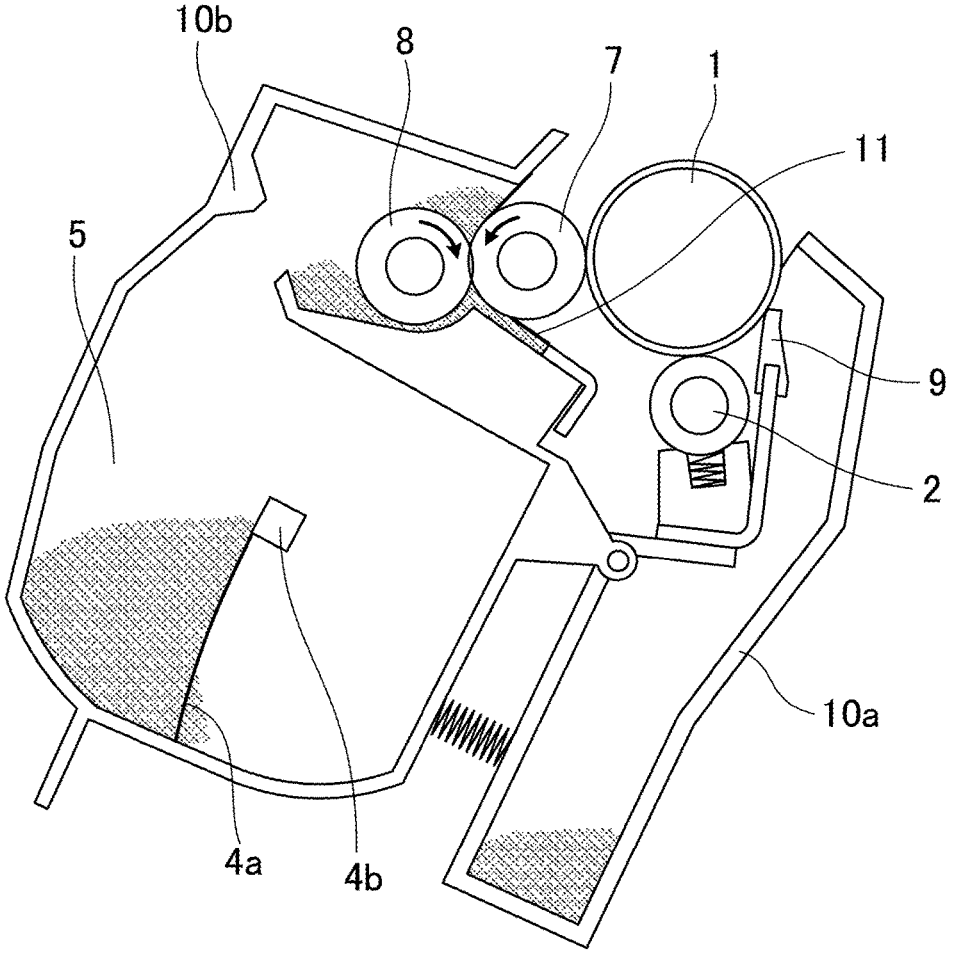
FIG. 3 is a sectional view of the process cartridge according to Embodiment 1.

With reference to FIG. 2 and FIG. 3, the configuration and the operation of an image forming apparatus according to the present embodiment are described. FIG. 2 is a schematic configuration view of the image forming apparatus, and FIG. 3 is a schematic view of a process cartridge that is removably mounted to the image forming apparatus. In FIG. 2 and FIG. 3, members having the same function are denoted by the same reference symbols, and the redundant description is omitted. In the present embodiment, the configuration and the operation of process cartridges for respective colors are substantially the same except for types (colors) of developer that the process cartridges store.

The process cartridge includes a photosensitive drum (image bearing member) 1 (1Y, 1M, 1C, or 1K). The photosensitive drum 1 is a rotation drum-type electrophotographic photosensitive member that is an image bearing member. The photosensitive drum 1 of the present embodiment included a substrate being an aluminum base pipe with a diameter of 24 mm and a thickness of 0.7 mm, and an organic photosensitive member (photosensitive layer) applied on the outer peripheral of the substrate. The organic photosensitive member has negative charging performance, and the photosensitive drum 1 is driven to rotate by a drive motor (not shown) at a predetermined circumferential speed in the clockwise direction, which is indicated by the arrow. The photosensitive drum 1 is uniformly charged by a charging device to a predetermined negative potential in the process of its rotation. Specifically, in a contact charging device using a charging roller 2 (2Y, 2M, 2C, or 2K) as a charging member, the charging roller 2 is in contact with the photosensitive drum 1 so that the charging roller 2 rotates along with rotation of the photosensitive drum 1 to charge the surface of the photosensitive drum 1. Here, the charging roller 2 receives a bias voltage of −1,000 V from a charging bias power supply (not shown), and uniformly charges the surface of the photosensitive drum at −500 V.

Next, a laser exposure device 6 performs image exposure. The laser exposure device 6 forms electrostatic latent images on the uniformly charged photosensitive drum 1 and is a semiconductor laser scanner in the present embodiment. The laser exposure device 6 outputs laser light modulated on the basis of an image signal transmitted from a host device (not shown) in the image forming apparatus, thereby performing scan exposure (image exposure) on the uniformly charged surface of the photosensitive drum 1. With this, a potential at the light-exposed portion of the surface of the photosensitive drum 1 drops to −100 V, and electrostatic latent images based on the image information are subsequently formed.

Next, the electrostatic latent image is developed by a developing apparatus 5 (developing unit) to be a visualized toner image. The developing apparatus 5 includes a housing 10*b* in which toner is stored. The toner is supplied to a developer supplying member 8 when a stirring rod 4*b* rotates to rotate a stirring blade 4*a*. The present embodiment employed a non-magnetic one component contact developing system. In this system, a DC developing bias voltage (−300 V) is applied to the developing roller (developer bearing member) 7 from a developing bias power supply, which is not shown. With this, the electrostatic latent image on the surface of the photosensitive drum 1 is reversely developed with the use of the toner negatively charged at the contact portion between the developer supplying member 8 (8Y, 8M, 8C, or 8K) and the developing roller 7 (7Y, 7M, 7C, or 7K), and the contact portion between a developer layer thickness regulating member 11 and the developing roller 7.

Thereafter, a voltage of +1,500 V is applied to a primary transfer roller 13 (13Y, 13M, 13C, or 13K) from a transfer bias power supply, which is not shown, and the negatively charged toner on the photosensitive drum 1 is transferred onto an intermediate transfer member 12 that is rotationally moving in the direction of the arrow.

Meanwhile, a pickup roller 16 and a feed roller 17 of a feed cassette 15 are driven to rotate at a predetermined control timing. With this, recording materials S stored in the feed cassette 15 in a stacked manner are separately fed one by one to be supplied to a registration roller. The recording material S is conveyed by the registration roller to a secondary transfer roller 18 in synchronization with a timing at which a toner image arrives at a secondary transfer portion.

Moreover, at the secondary transfer portion, the toner image is transferred onto the recording material S such as a sheet, which has been fed from the feed cassette 15, when the intermediate transfer member 12 is pressed against the secondary transfer roller 18 by biasing member, which is a pressing spring, for example.

After being separated from the intermediate transfer member 12, the photosensitive drum 1 is exposed by a pre-exposure device, which is not shown, and the surface of the photosensitive drum is uniformly set to −70 V through charge removal. As the pre-exposure device, a plurality of LEDs are installed with a certain interval in a direction orthogonal to the rotation direction of the surface of the photosensitive drum 1. Thereafter, the surface of the photosensitive drum 1 is cleaned by a cleaning blade (cleaning member) 9 (9Y, 9M, 9C, or 9K) scrapping untransferred toner, and is then put into the charging process again. The cleaning blade 9 of the present embodiment collects untransferred toner that has not been transferred from the photosensitive drum 1 onto the transfer member 12 in the transferring process. The cleaning blade 9 is in contact with the photosensitive drum 1 with a constant pressure and cleans the surface of the photosensitive drum 1 by collecting untransferred toner. The toner collected through cleaning, which is called waste toner, is held in the housing 10*a*. In a similar manner, the intermediate transfer member 12 having untransferred toner remaining thereon after the secondary transfer is cleaned by a transfer member cleaning device 20 scrapping the untransferred toner, and is then put into the transferring process again.

The recording material S onto which the toner image has been transferred is separated from the photosensitive drum surface and is introduced into a fixing apparatus 19 to be subjected to toner image fixing. The fixing apparatus 19 fixes the toner image, which has been transferred onto the recording material S, as an image by means of heat and a pressure.

The recording material S that has passed through the secondary transfer roller 18 is separated from the photosensitive drum surface and is introduced into the fixing apparatus 19. The unfixed toner image on the recording material S is fixed, as a fixed image, by the fixing apparatus 19 with heat and pressure. Moreover, the recording material S on which the toner image has been fixed by the fixing apparatus 19 is discharged by a delivery roller 21 to a discharge tray provided outside the apparatus.

The image forming apparatus repeats the processes of charging, exposure, development, transferring, fixing, and cleaning with the use of the above-mentioned means, to thereby form images.

Figure 1:
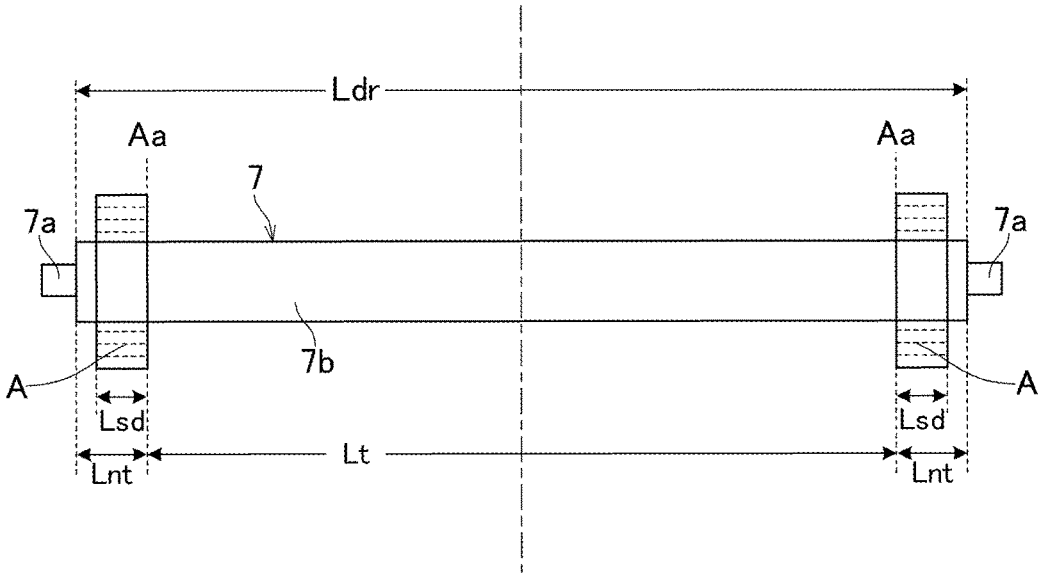
FIG. 1 is a plan view illustrating the arrangement of members in a process cartridge according to Embodiment 1.
Figure 4A:
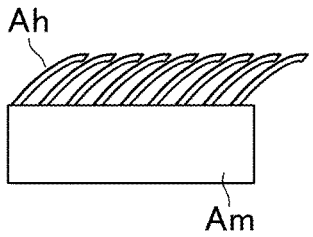
FIGS. 4A to 4C are model diagrams of a sealing member according to Embodiment 1.
Figure 4B:
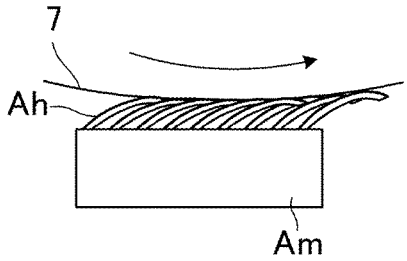
Figure 4C:
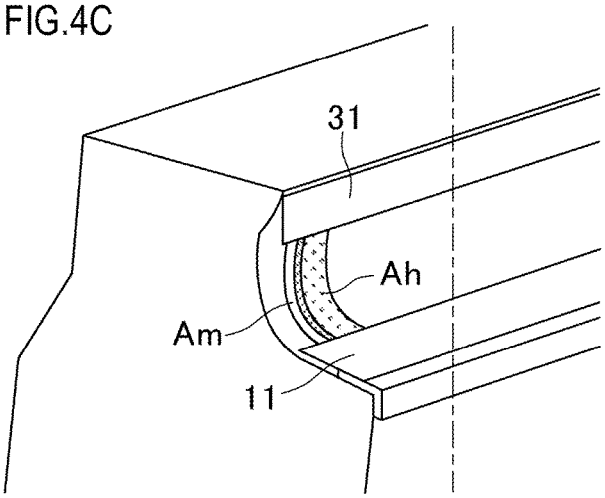

(2) Description on Relationship Between Developing Roller and Developer Sealing Member in Longitudinal Direction FIG. 1 is a view of the arrangement relationship in the process cartridge in the longitudinal direction. FIG. 4A is a sectional view of the developer sealing member. FIG. 4B is a sectional view of the contact region between the developer sealing member and the developing roller. FIG. 4C is a perspective sectional view when the developer sealing member is arranged without the developing roller. Here, the longitudinal direction is the rotation axis direction of the rotating member or a direction parallel to the rotation axis direction. The developing roller 7 includes, on the outer peripheral surface of a metal core 7*a* made of SUS (stainless steel), a conductive elastic body 7*b* with which the developing roller 7 has a diameter of 16 mm. The elastic body 7*b* has a length Ldr of 240 mm in the longitudinal direction. Although not shown, both the end portions of the metal core 7*a* are rotationally supported by the developing frame 10*b*. Moreover, the developing roller 7 is provided in parallel with the photosensitive drum 1, and the developing roller 7 is in pressure contact with the photosensitive drum 1 with predetermined pressing force.

In order to prevent toner (developer) from leaking from both the end portions of the developing frame 10*b* in the longitudinal direction, developer sealing members A are provided at both the end portions of the elastic body 7*b*. The sealing member A is provided so as to be in contact with the outer peripheral surface of the elastic body 7*b* and includes a raised-pile layer Ah on the surface in contact with the outer peripheral surface of the elastic body 7*b*. The raised-pile layer Ah includes, for example, a fiber-planted material, a pile fabric, felt, or rayon, and is bonded on a substrate Am that is moltoprene, for example. In the present embodiment, the raised-pile layer Ah that is a nylon pile (with a diameter of 25 μm and a length of 1.5 mm) is bonded to moltoprene. The raised-pile layer is deformed in the contact region with the developing roller 7, and a direction in which the pile is bent matches the rotation direction of the developing roller 7 (the direction of the arrow in FIG. 4B). This prevents toner from entering the raised-pile layer Ah from the boundary between the toner coating region and the toner non-coating region. When toner enters the raised-pile layer Ah, toner adhesion is caused in the contact region with the raised-pile layer Ah, resulting in toner leakage. In order to prevent toner from leaking from both the end portions in the longitudinal direction, the developer sealing member A had a length Lsd of 5 mm in the longitudinal direction.

Toner leakage in the lateral direction (direction perpendicular to the longitudinal direction) is prevented with the layer thickness regulating member 11 and a blowout preventing sheet 31 that are arranged so that pressing force is generated against the developing roller 7. The layer thickness regulating member 11 is fixed by welding a SUS plate with 80 μm to an L-shaped sheet metal with a YAG laser and fastening the L-shaped sheet metal to the developing frame 10*b* with a screw. The blowout preventing sheet 31 is fixed by bonding PET with 50 μm to the developing frame 10*b* with a double-sided tape.

Here, as illustrated in FIG. 1, the inner both end portions of the developer sealing member A in the longitudinal direction are denoted by Aa. A region to which toner is applied by the developing blade 11, that is, a toner coating region Lt that is a distance in the longitudinal direction between the inner both end portions Aa of the developer sealing members A at both the end portions has a length of 222 mm. Thus, a region Lnt to which no toner is applied and which is located on the outer side of the inner both end portions Aa of the developer sealing member A in the longitudinal direction have a length of 9 mm in the longitudinal direction. In the present embodiment, the toner coating region (developing zone) Lt of the developing roller 7 has the length of 222 mm, and hence short edge feed of A4 size recording materials S and long edge feed of A5 size recording materials S can be performed.

(3) Description on Coating Agent for Developing Roller

As described above, the developing roller 7 is in contact with the developer layer thickness regulating member 11, and the developing roller 7 has, as lubricant, the coating agent (for example, a silicone resin having an average particle size of 2 μm) applied thereto in shipping. The coating agent is applied because if no coating agent is present between the developing roller 7 and the developer layer thickness regulating member 11 when the process cartridge is put into use, the developer layer thickness regulating member 11 may be damaged due to a rise in frictional force. In addition, this coating agent is in contact with the developing roller 7 and the developer layer thickness regulating member 11 in a period from the manufacture until when the process cartridge is put into use, and hence is an agent that hardly causes chemical reaction. In the following description, the term "particle size" means an average particle size. Particle sizes were measured using a particle size analyzer Coulter LS230 manufactured by Beckman Coulter, Inc.

In the present embodiment, coating agents having different particle sizes are used in the toner coating region Lt and the toner non-coating region Lnt. A coating agent in the toner coating region is referred to as a coating agent P (second lubricant), and a coating agent in the toner non-coating region is referred to as a coating agent Q (first lubricant). The following relationship is satisfied: the coating agent Q in the toner non-coating region has a particle size smaller than the roughness Ra of the developing roller 7, and the coating agent P in the toner coating region has a particle size larger than the roughness Ra of the developing roller 7. The roughness Ra of the developing roller 7 was 0.9 μm, the coating agent P in the toner coating region was a silicone resin having a particle size of 2 μm, and the coating agent Q in the toner non-coating region was zinc stearate having a particle size of 0.5 μm. Further, the coating agents P and Q have properties that when the coating agents P and Q are charged, the coating agent Q is smaller in absolute value of a charge amount per unit area than the coating agent P. Here, the roughness Ra was measured with the use of a laser microscope VK-X210 manufactured by KEYENCE CORPORATION and was quantified in the standard of JIS B0601:2001. The measurement conditions and the analysis conditions were as follows. The measurement conditions of the present embodiment are as follows: lens: standard lens 20.0×, lens NA: 0.460, measurement size: high definition, measurement mode: surface profile, RPD: ON, measurement pitch: 0.5 μm, double scan: OFF, brightness: 6,820, and laser lightning filter: 30% of light amount. Moreover, the analysis conditions of the present embodiment are as follows: secondary curved surface correction: automatic, and filtering: median processing size 3×3 and execution frequency of one. In all of Embodiment and Comparative Examples, the surface layer hardness of the developing roller 7 was 37°, which was a value measured by an MD1 hardness tester.

Now, the present embodiment is described with the use of Comparative Examples having different relationships between the particle size of the coating agent and the roughness Ra of the developing roller 7 in the respective regions.

Comparative Example 1

Comparative Example 1 satisfies a relationship that the coating agent P in the toner coating region and the coating agent Q in the toner non-coating region both have the particle size larger than the roughness Ra of the developing roller 7. The roughness Ra of the developing roller 7 was 0.9 μm, and a silicone resin having a particle size of 2 μm was applied to both of the toner coating region and the toner non-coating region.

Comparative Example 2

Comparative Example 2 includes the developing roller 7 with the roughness Ra of at least 1.2 μm and satisfies a relationship that the coating agent P in the toner coating region and the coating agent Q in the toner non-coating region both have the particle size larger than the roughness Ra of the developing roller 7. The roughness Ra of the developing roller 7 was 3.0 μm, and a silicone resin having a particle size of 11 μm was applied to both of the toner coating region and the toner non-coating region.

Table 1 shows the relationship between the coating agent, the particle size of the coating agent, and the roughness Ra of the developing roller 7 in the respective regions in the present embodiment and Comparative Examples 1 and 2.

TABLE 1

| | Developing roller roughness Ra | Toner coating region Coating agent P | Toner non-coating region Coating agent Q | Banding image | Fogging |
|---|---|---|---|---|---|
| Example 1 | 0.9 μm | Particle size 2 μm Silicone resin | Particle size 0.5 μm Zinc stearate | ○ | ○ |
| Comparative Example 1 | 0.9 μm | Particle size 2 μm Silicone resin | Particle size 2 μm Silicone resin | X | ○ |
| Comparative Example 2 | 3 μm | Particle size 11 μm Silicone resin | Particle size 11 μm Silicone resin | ○ | X |

Which of "O" and "X" was given to the banding image sections was determined on the basis of the result of frequency analysis of chromaticity L* with respect to a solid black image, which had been digitalized by being read by an image scanner, in a direction in which periodic lateral stripes are formed. Which of "O" and "X" was given to the banding sections was determined as follow: "X" was given when a value obtained by multiplying a visual sensitivity curve VTF (visual transfer function) to the result of the frequency analysis of the chromaticity L* was at least 0.1, and "O" was given when the value was less than 0.1. As the VTF, the Dooley's approximate expression was used, and the observation distance was 600 mm. As the image scanner, CanoSean 8800 manufactured by Canon Inc. was used, and the image was scanned with 600 dpi. Which of "O" and "X" was given to the fogging sections was determined as follows: a value with reference to the reflection density of a sheet before printing was measured using a reflection densitometer, and "X" was given when the value was at least 44% and "O" was given when the value is less than 44%. As the reflection densitometer, MODEL TC-6DS/A30 manufactured by Tokyo Denshoku CO., LTD. was used.

In Embodiment 1, when the process cartridge is put into use, the developing roller 7 and the photosensitive drum 1 start to rotate while being in contact with each other in the toner non-coating region.

Figure 5A:
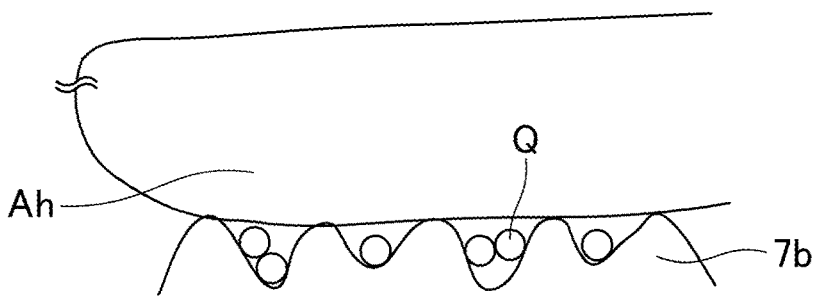
FIGS. 5A to 5C are sectional views of the contact state between members according to Embodiment 1.

FIG. 5A is a sectional view of the contact state between the developing roller 7 and the developer sealing member A. In the contact region between the developing roller 7 and the developer sealing member A, the raised-pile layer Ah of the developer sealing member A is deformed. While the developing roller 7 has the roughness Ra of 0.9 μm, zinc stearate serving as the coating agent Q has the particle size of 0.5 μm, which is smaller than the roughness Ra, and hence the coating agent Q present in the depressed portion of the surface profile of the developing roller 7 is not in contact with the raised-pile layer Ah of the developer sealing member A. The coating agent Q therefore hardly disappears from the developing roller 7.

Figure 5B:
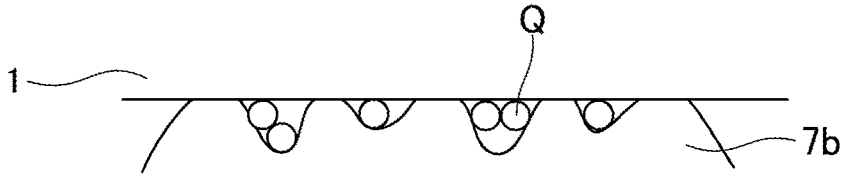

FIG. 5B is a sectional view of the contact state between the developing roller 7 and the photosensitive drum 1. In the contact region between the developing roller 7 and the photosensitive drum 1, the elastic body 7*b* of the developing roller 7 is deformed. Thus, even under the situation where while the developing roller 7 has the roughness Ra of 0.9 μm, zinc stearate serving as the coating agent Q has the particle size of 0.5 μm, which is smaller than the roughness Ra, the protruded portion of the developing roller 7 is deformed, and zinc stearate present in the depressed portion is brought into contact with the photosensitive drum 1 to function as lubricant. Because zinc stearate is in contact with the photosensitive drum 1, some zinc stearate is transferred onto the photosensitive drum 1, but such zinc stearate passes through the cleaning blade 9 without being cleaned and returns to the contact region between the developing roller 7 and the photosensitive drum 1 again. Through the above-mentioned processes, a reduction in coating agent on the developing roller 7 is prevented, and the lubricating effect in the contact region between the developing roller 7 and the photosensitive drum 1 is maintained. As a result, stick-slip of the elastic body 7*b* serving as the surface layer of the developing roller 7 can be prevented, and formation of banding images can thus be prevented.

Figure 5C:
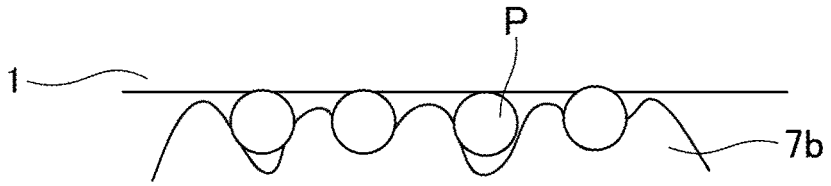

Next, the disappearance of the coating agent in the toner coating region that is exhibited when the process cartridge is put into use is described. FIG. 5C is a sectional view of the contact state between the developing roller 7 and the photosensitive drum 1. When the process cartridge is put into use, while the developing roller 7 has the roughness Ra of 0.9 μm, a silicone resin serving as the coating agent P has the particle size of 2 μm, which is larger than the roughness Ra, and hence the coating agent is brought into contact with the photosensitive drum 1 in a positive manner to be satisfactorily discharged. In the present embodiment, the silicone resin having the particle size of 2 μm is negatively charged. The silicone resin disappears in a positive manner through development on the photosensitive drum 1 with the use of a potential difference when the process cartridge is put into use. If the process cartridge continues to be used with the silicone resin still remaining, coating agent melt adhesion is caused with the developer layer thickness regulating member 11, with the result that toner on the developing roller 7 is disturbed, leading to an adverse effect of vertical streaks on an image.

Figure 6:
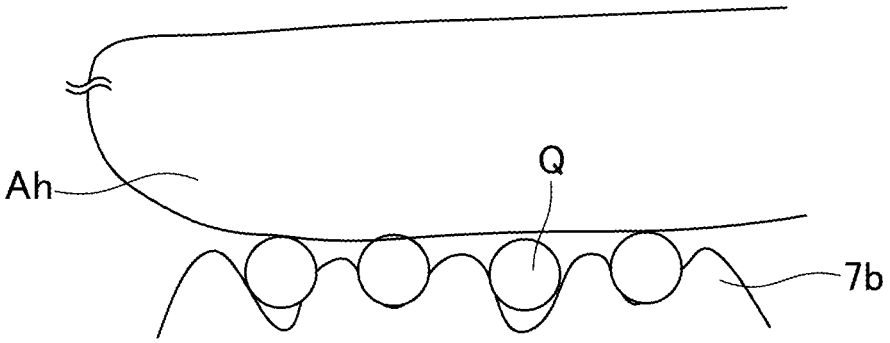
FIG. 6 is a sectional view of the contact state between a developing roller and a developer sealing member according to Comparative Example 1.

Next, the case of Comparative Example 1 is described. FIG. 6 is a sectional view of the contact state between the developing roller 7 and the developer sealing member A. When the process cartridge is put into use, the developing roller 7 and the photosensitive drum 1 start to rotate while being in contact with each other in a toner non-coating region. In the contact region between the developing roller 7 and the developer sealing member A, the raised-pile layer Ah of the developer sealing member A is deformed. In Comparative Example 1, while the developing roller 7 has the roughness Ra of 0.9 μm, a silicone resin serving as the coating agent Q has the particle size of 2 μm, which is larger than the roughness Ra. Thus, even though the silicone resin is present in the depressed portion of the surface profile of the developing roller 7, the silicone resin tends to disappear from the developing roller 7 by being brought into contact with the raised-pile layer Ah of the developer sealing member A to be mechanically taken off. The coating agent on the developing roller 7 is consequently reduced with increasing speed, and the lubricating effect in the contact region between the developing roller 7 and the photosensitive drum 1 is reduced. As a result, stick-slip of the elastic body 7*b* serving as the surface layer of the developing roller 7 is caused to form a banding image. What is described about the toner coating region in Embodiment 1 is applied to a toner coating region here.

The case of Comparative Example 2 is described. In Comparative Example 2, the roughness Ra of the developing roller 7 is sufficiently large. Thus, frictional force in the contact region between the developing roller 7 and the photosensitive drum 1 is low without the coating agent, and hence stick-slip of the elastic body 7*b* serving as the surface layer of the developing roller 7 is not caused. However, due to the roughness, the developing roller 7 has too large toner conveying force and a thick toner layer is formed on the developing roller 7. As a result, the charging performance of the developer layer thickness regulating member 11 drops, leading to formation of an image with fogging in which toner with low charging performance is developed in white parts.

As described above, in Embodiment 1, the following relationship is satisfied: the coating agent Q in the toner non-coating region has the particle size smaller than the roughness Ra of the developing roller 7, and the coating agent P in the toner coating region has the particle size larger than the roughness Ra of the developing roller 7. Thus, the retention of the coating agent in the toner non-coating region is increased while the disappearance of the coating agent in the toner coating region that is exhibited after the process cartridge has been put into use is maintained, with the result that formation of banding images can be prevented. In the present embodiment, two types of coating agents were used for the toner coating region and the toner non-coating region, but the present invention is not limited thereto. That is, one type of coating agent may be used as long as a surface roughness in the toner coating region to which the coating agent is applied is larger than the particle size of the coating agent, and a surface roughness in the toner non-coating region to which the coating agent is applied is smaller than the particle size of the coating agent.

Examination of changing the roughness Ra of the developing roller 7 was made with the use of the configuration of Embodiment 1, and it was obtained that the retention of the coating agent Q on the developing roller 7 was high when the roughness Ra of the developing roller 7 was larger than 0.7 μm. As a result, improvement of the frequency analysis peak of banding images was observed. From this result, it is found that when the particle size of the coating agent Q having entered the depressed portion of the surface of the developing roller 7 satisfies a relationship: (roughness Ra of developing roller 7)−(particle size of coating agent Q)>0.2 μm, the coating agent Q can positively remain in the depressed portion.

Further, examination of changing the roughness Ra of the developing roller 7 in the toner non-coating region without the coating agent with the use of the configuration of Embodiment 1, and improvement of banding was observed when the roughness Ra of the developing roller 7 was at least 1.5 μm. However, an increase in degree of fogging in an image was observed when the roughness Ra of the developing roller 7 was at least 1.2 under a high temperature and high humidity (32.5° C., 80%) environment.

The material of the coating agent P, which was a silicone resin serving as lubricant, may be, for example, polyethylene terephthalate (PET) or boron nitride powder, that is, any powder that gives lubricity to the surface of the photosensitive drum 1. The present invention is not limited to the material. The region to which the coating agent P is applied is the entire toner coating region in Embodiment 1. However, the coating agent P may not be applied to the entire region as long as being applied in an enough range to prevent the damage of the layer thickness regulating member at the initial stage. In particular, when the coating agent P and the coating agent Q are desirably not mixed with each other, a non-application portion may be formed at the boundary therebetween. The coating agent P may be applied by an enough amount, which includes the amount of the coating agent P in the application region, to prevent the damage of the layer thickness regulating member in the initial stage. In Embodiment 1, 0.005 mg/mm$^2$ of the coating agent P is applied to the surface of the developing roller 7.

The material of the coating agent Q, which was zinc stearate serving as lubricant, may be, for example, polyethylene terephthalate (PET) or boron nitride powder, that is, any powder that gives lubricity to the surface of the photosensitive drum 1. The present invention is not limited to the material. The region to which the coating agent Q is applied is the entire toner non-coating region in Embodiment 1. However, the coating agent Q may not be applied to the entire region as long as being applied to an enough region to provide the lubricity of the coating agent Q, thereby preventing banding images. The coating agent Q may be applied by an enough amount, which includes the amount of the coating agent Q in the application region, to prevent banding images. In Embodiment 1, 0.004 mg/mm$^2$ of the coating agent Q is applied to the surface of the developing roller. As a matter of course, in addition to the configuration of the present embodiment, when the coating agent in the toner non-coating region is given charging performance opposite to the polarity of toner, the amount of the coating agent transferred onto the photosensitive drum can be reduced, and the retention of the coating agent on the developing roller 7 can be increased. As an example, urethane particles each having a particle size of 0.5 μm are given.

Embodiment 2

Embodiment 2 is different from Embodiment 1 in material of the developer sealing member A. Embodiment 2 is similar to Embodiment 1 except for that point, and part of the description on the present embodiment that is redundant to Embodiment 1 is omitted.

Figure 7:
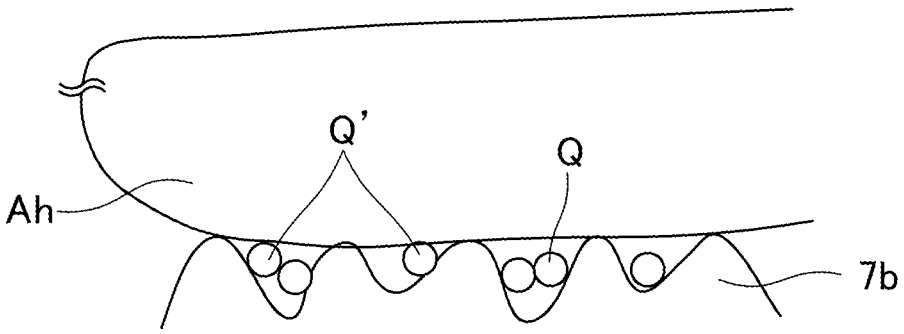
FIG. 7 is a sectional view of the contact state between a developing roller and a developer sealing member according to Embodiment 2.

In Embodiment 2, the raised-pile layer Ah is made the material of PTFE (polytetrafluoroethylene), which is a different point from Embodiment 1. FIG. 7 is a sectional view of the contact state between the developing roller 7 and the developer sealing member A. In the contact region between the developing roller 7 and the developer sealing member A, the raised-pile layer Ah of the developer sealing member A is deformed. While the developing roller 7 has the roughness Ra of 0.9 μm, zinc stearate serving as the coating agent Q has a particle size of 0.5 μm, which is smaller than the roughness Ra, and hence the coating agent Q present in the depressed portion of the surface profile of the developing roller 7 is not in contact with the raised-pile layer Ah of the developer sealing member A. The coating agent Q therefore hardly disappears from the developing roller 7. Moreover, the material of the raised-pile layer Ah is PTFE, and hence even in a case where the raised-pile layer Ah of the developer sealing member A and zinc stearate are lightly in contact with each other as indicated by Q' in FIG. 7, the coating agent tends to remain on the developing roller 7 due to weak adhesion of PTFE. As a result, the retention of the coating agent in the toner non-coating region can be increased, and formation of banding images can be prevented in a more effective manner than Embodiment 1. In the configuration of Embodiment 2, the frequency analysis peak of banding images is smaller than that of Embodiment 1. As a matter of course, the material is not limited to PTFE and may be any fluorine-based resin that can lower the adhesiveness.

Further, as Modified Example of Embodiment 2, there is a configuration in which the coating agent Q is applied to the raised-pile layer Ah of the developer sealing member A in advance. With this configuration, the coating agent Q can be supplied from the developer sealing member A to the developing roller 7, and hence the retention of the coating agent in the toner non-coating region can be increased, and formation of banding images can be prevented in a more effective manner than Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190450, filed on Sep. 29, 2017, which is hereby incorporated by reference herein in its entirety.

What is claimed is:

1. A developing apparatus, comprising:

a developing roller configured to bear developer;

a frame configured to rotationally support the developing roller at each of two end portions of the developing roller in a longitudinal direction of the developing roller; and a sealing member configured to seal a space between the frame and each of the two end portions of the developing roller, wherein the developing roller has:

first regions that are located at each of the two end portions of the developing roller in the longitudinal direction and are in contact with the sealing member; and a second region that is located between the first regions in the longitudinal direction and is not in contact with the sealing member, the second region having a predetermined surface roughness Ra, wherein the first regions have a first lubricant applied thereto, the first lubricant having a first average particle size smaller than the predetermined surface roughness Ra, and wherein the second region has a second lubricant applied thereto, the second lubricant having a second average particle size larger than the predetermined surface roughness Ra.

2. The developing apparatus according to 1, wherein the developer comprises a non-magnetic one component developer.

3. The developing apparatus according to 1, wherein a surface roughness in the first regions and a surface roughness in the second region are both less than 1.2 μm.

4. The developing apparatus according to 1, wherein A−B>0.2 μm is satisfied where a surface roughness in the first regions on the developing roller is indicated by A and an average particle size of the first lubricant is indicated by B.

5. The developing apparatus according to 1, wherein the first lubricant has a charging polarity opposite to that of the developer borne by the developing roller.

6. The developing apparatus according to 1, wherein an absolute value of a charge amount per unit area of the first lubricant in the first regions is smaller than an absolute value of a charge amount per unit area of the second lubricant in the second region.

7. The developing apparatus according to 1, wherein the first lubricant comprises one of zinc stearate, polyethylene terephthalate, and boron nitride, and the second lubricant comprises one of a silicone resin, polyethylene terephthalate, and boron nitride.

8. The developing apparatus according to 1, wherein the sealing member includes a raised-pile layer that is made of a fluorine-based resin and is in contact with the developing roller.

9. The developing apparatus according to 8, wherein the first lubricant is applied to the raised-pile layer.

10. A process cartridge, comprising:

an image bearing member on which an electrostatic latent image is formed; and the developing apparatus according to claim 1.

11. An image forming apparatus, comprising:

an apparatus main body; and the process cartridge according to claim 10, which is removably mounted to the apparatus main body.

12. A developing roller, comprising:

first regions which are located on a surface of the developing roller at each of two end portions of the developing roller in a longitudinal direction thereof and with which a sealing member is in contact, the sealing member being configured to seal a space between the developing roller and a frame by which the developing roller is rotationally supported; and a second region that is located between the first regions in the longitudinal direction and is not in contact with the sealing member, the second region having a predetermined surface roughness Ra, wherein the first regions have a first lubricant applied thereto, the first lubricant having a first average particle size smaller than the predetermined surface roughness Ra, and wherein the second region has a second lubricant applied thereto, the second lubricant having a second average particle size larger than the predetermined surface roughness Ra.

13. The developing roller according to 12, wherein the developing roller bears a non-magnetic one component developer.

14. The developing roller according to 12, wherein the second region is configured to be contactable with a regulating member that regulates a layer thickness of developer borne by the developing roller.

15. The developing roller according to 12, wherein the first regions and the second region are provided on a surface of an elastic layer of the developing roller.

16. The developing roller according to 12, wherein a surface roughness in the first regions and a surface roughness in the second region are both less than 1.2 μm.

17. The developing roller according to 12, wherein $A-B>0.2$ μm is satisfied where a surface roughness in the first regions is indicated by A and an average particle size of the first lubricant is indicated by B.

18. A developing apparatus, comprising:

a developing roller configured to bear developer and having a surface to which lubricant is applied;

a frame configured to rotationally support the developing roller at each of two end portions of the developing roller in a longitudinal direction of the developing roller; and a sealing member configured to seal a space between the frame and each of the two end portions of the developing roller, wherein the developing roller has:

first regions that are located at each of the both end portions of the developing roller in the longitudinal direction and are in contact with the sealing member; and a second region that is located between the first regions in the longitudinal direction and is not in contact with the sealing member, wherein a surface roughness in the first regions on the developing roller is larger than an average particle size of the lubricant, and wherein a surface roughness in the second region on the developing roller is smaller than the average particle size of the lubricant.

* * * * *